US006681950B2

(12) United States Patent
Miller, Jr. et al.

(10) Patent No.: US 6,681,950 B2
(45) Date of Patent: Jan. 27, 2004

(54) RECYCLING CONTAINER AND METHOD OF MANUFACTURE

(75) Inventors: Donald J. Miller, Jr., Belleville, IL (US); Andrew J. Boron, Belleville, IL (US)

(73) Assignee: Paul Flum Ideas, Inc., St. Louis, MO (US)

( * ) Notice: Subject to any disclaimer, the term of this patent is extended or adjusted under 35 U.S.C. 154(b) by 0 days.

(21) Appl. No.: 10/063,019

(22) Filed: Mar. 12, 2002

(65) Prior Publication Data

US 2003/0173363 A1 Sep. 18, 2003

(51) Int. Cl.[7] ..... B65D 25/14

(52) U.S. Cl. ..... 220/495.11; 220/375; 220/908.1; 40/662; 40/668

(58) Field of Search ..... 220/495.01, 495.11, 220/908, 908.1, 23.4, 375; 40/668, 662

(56) References Cited

U.S. PATENT DOCUMENTS 2,094,193 A * 9/1937 Summers ..... 40/651
3,052,371 A * 9/1962 Bemmelen ..... 220/530
3,803,738 A * 4/1974 Weiss ..... 40/306
4,248,278 A * 2/1981 Blodgett ..... 141/316
4,466,553 A * 8/1984 Zenger ..... 220/495.08
4,598,838 A * 7/1986 Zakrajsek ..... 220/495.11
5,105,972 A * 4/1992 Waterston et al. ..... 220/603
5,165,564 A * 11/1992 Prout et al. ..... 220/254.1
5,219,085 A * 6/1993 Craft et al. ..... 220/252
5,234,144 A * 8/1993 Iler ..... 224/191
D354,640 S 1/1995 Flum
5,385,259 A * 1/1995 Bernstein et al. ..... 220/495.11
D355,793 S 2/1995 Flum
5,425,469 A * 6/1995 Freedland ..... 220/495.11
5,448,844 A 9/1995 Miller, Jr. et al.
5,803,300 A * 9/1998 DeMars ..... 220/495.11
5,816,432 A * 10/1998 Hammen et al. ..... 220/530
5,910,162 A 6/1999 Harbour et al.
5,971,194 A * 10/1999 Freedland ..... 220/495.08
6,047,843 A * 4/2000 Mecke ..... 220/23.88
6,173,861 B1 * 1/2001 Houry ..... 220/828

* cited by examiner

*Primary Examiner*—Nathan J. Newhouse
*Assistant Examiner*—Joseph C Merek
(74) *Attorney, Agent, or Firm*—Blackwell Sanders Peper Martin, LLP

(57) ABSTRACT

A container for the collection of waste products including a base receptacle and a cover, the base receptacle having an upper lip portion, at least one rim portion and a supporting ledge. The cover is removably engageable with the base receptacle such that at least a portion of the cover engages at least a portion of the at least one rim portion when the cover is installed on the base receptacle thereby providing at least one peripheral area of contact between the cover and the base receptacle for securing a flexible bag liner therebetween. The base receptacle and cover are molded together as a one piece integral unit joined together by a web of material which connects the two component parts together. The cover is separated from the base receptacle by removal of the web of material.

21 Claims, 4 Drawing Sheets

RECYCLING CONTAINER AND METHOD OF MANUFACTURE

BACKGROUND OF INVENTION

This invention relates generally to containers for the collection of waste products and, more particularly, to a method and several embodiments of a waste container adaptable for use as a recycling container having a base receptacle and a removable cover positionable thereon, the installation of the cover member on the base receptacle providing at least one peripheral area of contact between the cover and the base receptacle for securing a flexible bag liner therebetween when installed.

Numerous refuse or waste containers are known in the industry and take many different forms involving many types of structures. Although many of these containers are adequate for their purpose, they have certain shortcomings particularly when used for specialized purposes such as for collecting and storing recyclable goods.

One type of waste or refuse container is an open top, uncovered receptacle that can have removably suspended therein a bag type liner which can be removed by refuse collection crews for transport to a landfill or a recycling site. However, often times, it is difficult to remove the liner from the container or, more frequently, the liner becomes dislodged from its mounting position around the upper lip of the container preventing collection of some refuse in the liner thereby requiring extra time by the crew to gather and recollect the waste. By having an open, uncovered top, the interior of the receptacle is exposed to weather elements such as rain and wind and if tipped over, the collected waste will spill requiring additional time by the collection crew to clean up. Further, because of the open top, a wide variety of different types of waste products and recyclable containers can be disposed of in the receptacle making recycling more difficult.

Waste receptacles are also provided with covers that are selectively removable. Such covers can take one of two basic forms. In one form, the cover itself is removed to provide access to the interior of the receptacle for the disposal of waste. For public use, the removal of a cover in order to dispose of waste is an inconvenience and therefore many people will not dispose of waste products in the receptacle but rather leave it as litter requiring clean up crews to gather and dispose of such waste. The second form of cover typically has a hinged door or the like associated therewith to selectively provide access to the interior of the receptacle. The use of hinged doors allows access into the interior of the container to both deposit and remove selected refuse and to visually see inside the interior of the receptacle. Hinged doors are generally rectangular in shape and they utilize one straight edge portion of the door for an elongate hinge and closure device (e.g., a spring) allowing for a wide variety of waste to be deposited in the receptacle. This type of cover is more convenient for the public but such doors are susceptible to wear, tear and breakage. They also sometimes become stuck in the open position exposing the interior of the receptacle to the elements. Still further, since such doors are not shape specific to any particular recyclable containers, a wide variety of waste can be deposited through such doors making it difficult at a recycling facility to separate recyclable material from non-recyclable material.

Covers may also be attached to the base receptacle. One form of attachment is by hingedly mounting the entire cover unit to the base. However, this typically leaves an exposed hinge and can negatively affect the aesthetics of the overall container. Further, the use of hinges requires that there be at least one generally straight side or edge to accommodate the hinge thereby limiting the potential number of available shapes and designs for the overall refuse container.

There is thus a need for an improved waste collection container particularly for the collection of recyclable material. Accordingly, the present invention is directed to overcoming one or more of the problems as set forth above.

SUMMARY OF THE INVENTION

The present invention relates to a refuse or waste container adapted particularly for the collection of recyclable materials. The refuse container includes a base receptacle having an upwardly opening mouth portion over which a portion of a flexible bag liner may be secured. A removable cover is provided for engagement with the base receptacle, the cover having an access port or opening selectively substantially sealed by a door. The mouth portion of the receptacle may include a plurality of differently sized perimeters to ensure a snug fit between the liner and the base receptacle. The cover may engage the liner in one or more longitudinally separated positions to help retain the liner in proper position within the base receptacle.

The cover and base receptacle may also be connected together by a flexible link member which is contained completely within the interior of the cover and base receptacle. The flexible link member can be positioned to help separate a flexible disposable liner from the base receptacle. A display panel may also be removably mounted to the exterior of the container such that it can be easily changed and/or replaced allowing for advertising indicia and other promotional information to be displayed on the container.

The present invention also relates to a method of making a waste container. The container is molded of a polymeric material as a one piece unit facilitating its manufacture by molding techniques such as blow molding or rotational molding. The cover portion and the base receptacle portion of the container are connected together during the molding process by a web of material that is formed integral with and extends between the cover portion and the receptacle portion. The cover and receptacle portions are then separated by removal of the web. Since both portions are molded simultaneously, the shrinkage (an inherent aspect of molding) after molding is substantially the same and predictable thereby simplifying the container manufacturing process and ensuring a compatible fit between the lower portion of the cover and the upper portion of the base receptacle.

These and other aspects and advantages of the present invention will become apparent upon reading the detailed description in connection with the drawings and the appended claims.

DETAILED DESCRIPTION

Figure 1:
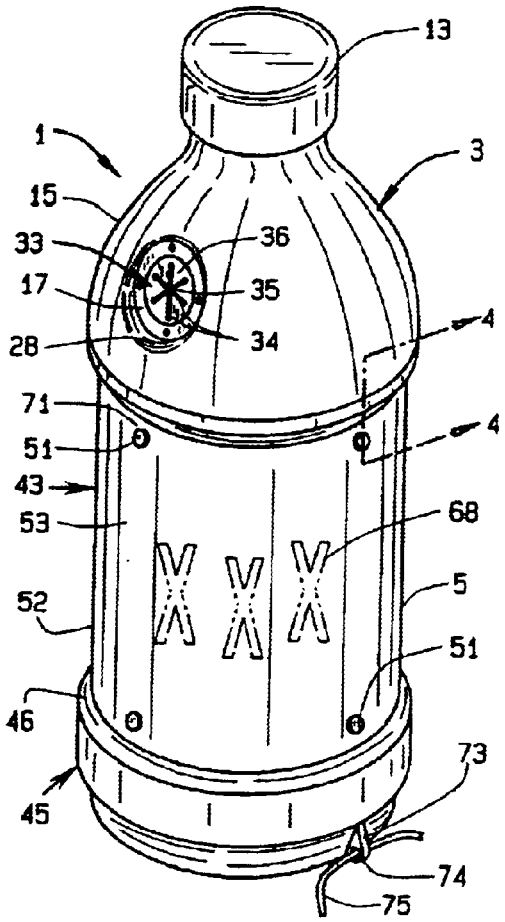
FIG. 1 is a perspective view of one embodiment of a waste container assembled for use in accordance with the teachings of the present invention.
Figure 3:
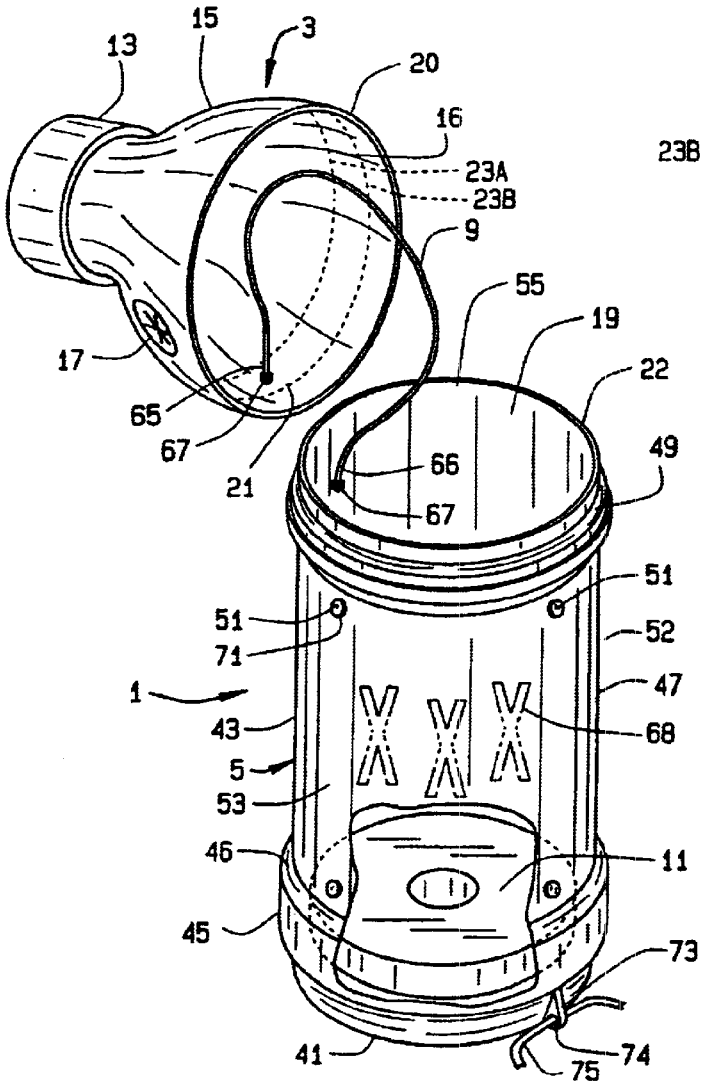
FIG. 3 is an exploded perspective view of the container of FIG. 1.

Referring to the drawings more particularly by referenced members wherein like numerals throughout the various drawings refer to like parts, as best illustrated in FIGS. 1 and 3, the reference numeral 1 designates generally a refuse or waste container that includes a cover 3 and a base receptacle 5. A flexible bag liner 7 (FIG. 4) may be inserted into the receptacle for the collection, storage and removal of waste (not shown). A flexible link member 9 (FIGS. 3 and 6) may likewise be secured to both the cover 3 and receptacle 5 connecting the same together to prevent loss when the cover 3 is removed from the receptacle 5. An optional weight 11 may be provided in the receptacle 5 to help prevent tip-over of the overall container 1. The weight 11 is shown in dotted outline form in FIG. 3 and rests in the lower interior portion of the receptacle 5. The container 1 can be of any suitable shape such as that of a beverage bottle as illustrated.

The cover 3, as best seen in FIGS. 1 and 3, includes a top portion designated 13 and a side wall portion 15 depending from the top 13. The cover 3 has a hollow interior 16 to provide for both lightness in weight and a pathway for the passage of refuse to the receptacle 5 that is placed through a port or passageway 17 in the side wall 15. The passageway 17 communicates with a hollow interior 19 in the receptacle 5. The lower end portion 20 of the cover 3 defines an open mouth or receiving area 21 for receipt of an upper portion 22 of the receptacle 5 therein. Alternately, the lower end 20 of the cover 3 may be received inside of the upper end 22 of the receptacle 5 to form the overall container 1. The lower end portion 20 of cover 3 is preferably tapered or otherwise contoured to provide two separate areas or zones of contact 23A and 23B with the upper end portion 22 of receptacle 5 and/or the liner 7 as best shown is FIG. 4 and as will be hereinafter further described. The areas 23A and 23B extend peripherally around at least a substantial portion and as shown the entirety of the interior of the lower end portion 20. The areas 23A and 23B are spaced apart in the direction of the longitudinal axis of the container 1. This is a vertical separation when the container 1 is in its normal upright position.

The port 17 (FIG. 5) provides an opening 24 through the side wall 15 permitting the placement of waste into the interior 19 of the receptacle 5, and liner 7 if used. Because of the contour of the side wall 15 which expands in perimeter downwardly and outwardly, the top portion 25 of the opening 24 (FIG. 2 and FIG. 5) is spaced inwardly toward the longitudinal axis of the container 1 less than the bottom portion 27. Because the plane of the port 17 is generally vertical, a sill 28 is formed in the side wall 15 adjacent the bottom portion 27 of opening 24. Preferably the sill 28 slopes downwardly and outwardly away from the opening 24 to provide for runoff of liquids such as rain or spilled material from the waste products. This helps prevent unnecessary moisture or other liquids from entering the container and contaminating the waste products particularly if such waste products are to be recycled. The opening 24 has a flange portion 30 (FIG. 5) surrounding the opening for attaching the door 33 as will be hereinafter explained. The sill 28 and flange 30 are preferably formed during the molding process of the cover 3 forming an integral assembly. The opening 24 may be formed by cutting or machining such as with a rotary cutter or the like. The opening 24 provides access from the exterior of the cover 3 to the interior of the receptacle 5.

Figure 5:
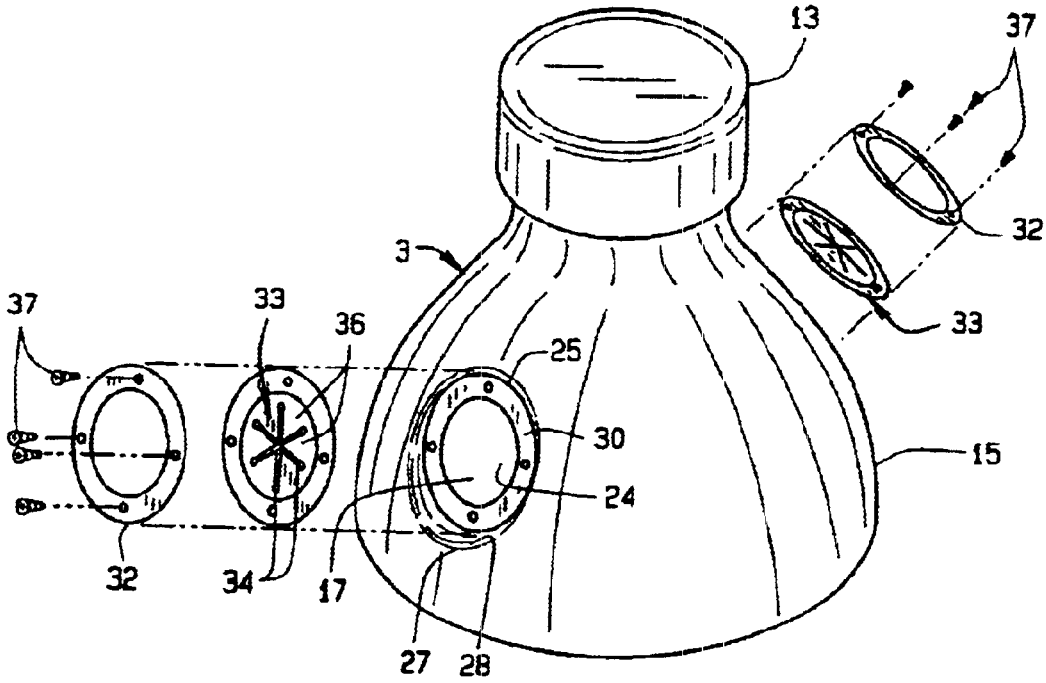
FIG. 5 is an enlarged exploded perspective view of the cover, access port and door.

The door 33 is provided to substantially or completely close and seal the opening 24 providing selective access through the door into the interior of the container 1 as best illustrated in FIG. 5. Any suitable door can be provided and is preferably of the self closing type and is also operable to help prevent the depositing of certain types of debris or waste in the container 1. In the illustrated structure, the preferred embodiment of door 33 is a multi-flap type door formed by cutting a series of generally radially projecting slots or cuts 34 from a central point 35. The cuts 34 form a plurality of generally V-shaped flaps 36. The door 33 is preferably made of a resiliently deformable polymeric material such as vinyl or rubber which can be easily cut and is durable and resistant to failure from fatigue. The length of the cuts 34 and the flexibility of the door material will determine and control the size of waste products that can be placed into the container 1 and will help prevent the placement of undesirable refuse into the container 1. For example, the container 1 is advantageously designed to accept beverage bottles and containers at a sports park or the like. The structure and rigidity of these containers is sufficient to effect deformation of the flaps 36 when those containers are inserted through the opening 24 and door 33. On the other hand, paper debris and other such soft material do not have enough rigidity to effect deformation of the flaps 36 making it difficult to deposit paper or other soft material in the container 1. The door 33 thereby limits, to some degree, the type and size of waste that can be deposited in the container 1. The container 1 may be advantageously used in association with other types of trash containers at a location. The door 33 is suitably secured to the flange 30, for example, through the use of a ring or collar member 32 which is received over and around a peripheral portion of door 33 through the use of conventional fasteners 37. A peripheral portion of the door 33 is captured between the ring member 32 and flange 30.

Figure 4:
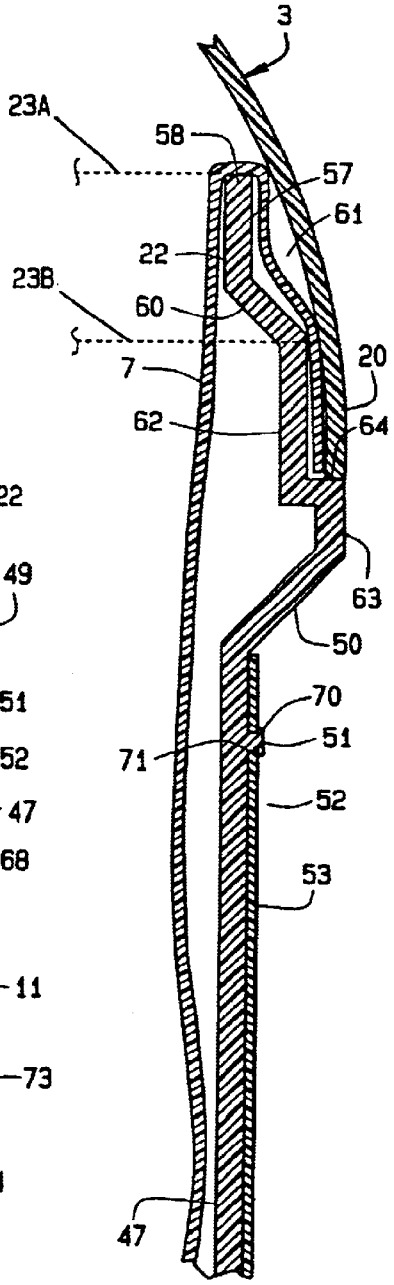
FIG. 4 is an enlarged fragmentary cross-sectional view taken along the line 4—4 of FIG. 1 with the cover in place to show details of the mouth areas of both the cover and the base receptacle.

The receptacle 5, as best illustrated in FIGS. 1 and 3, includes a bottom floor 41 and an upstanding side wall 43 integral therewith. The side wall 43 includes an enlarged collar 45 adjacent the bottom floor 41, the collar 45 having an upper flange 46 defining the top part of the collar 45. The flange 46 projects generally radially outwardly from a generally straight section 47 of side wall 43, which straight section is generally cylindrical in the illustrated structure. At the upper portion 22 of the receptacle 5, an enlarged collar 49 is provided. At the lower end of collar 49 there is provided a flange 50 projecting outwardly from the substantially straight side wall section 47 (FIG. 4). The straight section 47 and flanges 46 and 50 define a peripheral recess 52 that can be utilized to display a graphic panel 53 or other advertising indicia. The recessed area 52 may extend around the entirety of the receptacle 5, if desired. In the illustrated structure, there are a plurality of hangers or retainers 51 which cooperate with the display panel 53 to removably mount the panel 53 to the exterior of the receptacle 5 preferably in the recessed area 52 such that the outer face of the panel is spaced inwardly from the outer perimeter of each of the collars 45 and 49. The hangers 51 are projections preferably molded at the time of molding the container 1 but may also be separate elements suitably secured to the receptacle 5.

The upper end 22 of the receptacle 5 has a portion thereof mating with the lower portion 20 of the cover 3 to provide for removable mounting of the cover 3 to the receptacle 5 as best shown in FIGS. 1 and 3. In the illustrated structure, the upper end 22 includes an upper upstanding lip 57 having an upper end portion 58 defining the perimeter to the opening of the mouth 55. The outer periphery of the lip 57 is sized and shaped to be received within the mouth 21 of the cover 3 and it is also sized and shaped to receive thereover the upper portion of the liner 7. At the lower end of the lip 57 there is provided an outwardly extending shelf 60 terminating at its outer end into a rim portion 62 that is sized and shaped similar to the inside of the lower end 20 of the cover 3 for receipt therein, preferably with a slight amount of interference fit. Extending outwardly from the lower end of the rim portion 62 is another rim portion 63 forming a ledge 64 that has an outer dimension larger than the lower end 20 of the cover 3 to limit axial movement of the cover 3 onto the upper end of the receptacle 5. The perimeter of the rim portion 62 is larger than the perimeter of the lip 57. This provides for a snug fit between the liner 7 and the lip 57 and/or the rim portion 62 to ensure that the liner 7 stays in position in the receptacle 5 during use. Further, the lower end 20 of the cover 3 is tapered or otherwise contoured as best illustrated in FIG. 4 to provide two separate peripheral areas of contact 23A and 23B between the inside surface of the cover 3 and the outer surface of the upper end 22 of receptacle 5 to frictionally engage the liner 7 between at least one of the areas of contact 23A and 23B and preferably between both areas of contact between the cover 3 and receptacle 5 around at least a portion of the perimeter of the receptacle 5 and preferably the entire perimeter. The perimeter of area 23A is smaller than the perimeter 23B to accommodate the taper of the lower end 20. The liner 7 may be secured through either contact with the lip 57 and/or with the rim portion 62. A gap 61 is formed between a lower portion of the lip 57 and the inside of the lower end 20 of cover 3 to help prevent contact between the liner 7 and a portion of both the inside surface of the lower end 20 of cover 3 and the outside surface of the lip 57. The use of a plurality of different sized lip and rim portions on the upper end of the receptacle 5 permits for size variation in the liner 7 while still ensuring a snug fit of the liner 7 with at least one portion of the receptacle 5.

Figure 6:
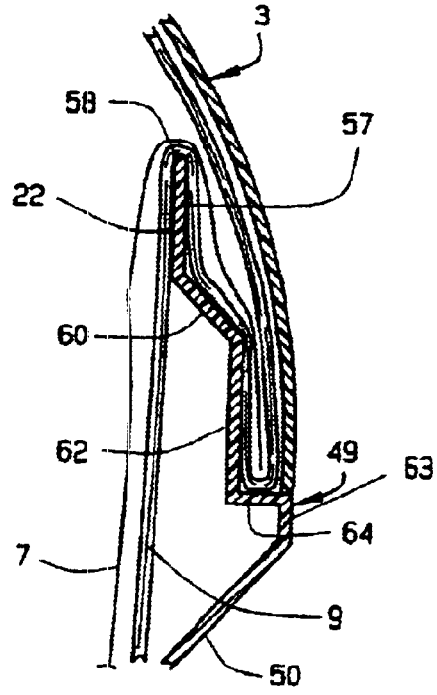
FIG. 6 is an enlarged fragmentary cross-sectional view of an upper portion of the receptacle of FIGS. 1–5 showing the relationship between a typical bag liner and the flexible link member.

It is also desirable to ensure that the cover 3 not become separated from the receptacle 5 when removed. It has been found advantageous to provide the flexible link member 9 having opposite end portions 65 and 66 thereof secured respectively to the cover 3 and receptacle 5 (FIG. 3). Preferably the link member 9 is a flexible metal cable or rope having the opposite ends 65 and 66 each respectively secured to the cover 3 or the receptacle 5. Preferably the entirety of the link member 9 is contained within the cover 3 and/or receptacle 5 when the cover 3 is installed on the receptacle 5. This can advantageously be accomplished by the use of a flexible cable having a small diameter (e.g., about 1/16 inch to about 1/8 inch). A thin flat strap may also be used. A portion of the cable 9 can simply be bent over the lip 57 and can be positioned between the liner 7 and the lip 57 on both sides of the lip as best illustrated in FIG. 6. In this arrangement, the link member 9 does not interfere with the installation or removal of the cover 3. It also provides a means to assist in the removal of the liner 7 from the receptacle 5 by simply pulling the link member 9 which would remove a portion of the upper end of the liner 7 from the receptacle 5. In the illustrated structure, the link member 9 is secured at opposite ends to couplers or other attachment devices 67. To simplify molding, it is preferred that the couplers 67 be separate elements each secured to a respective cover 3 or receptacle 5 as, for example, through the use of screw connectors, adhesive means or by fusion.

As illustrated in FIGS. 1, 3 and 4, the display panel 53 is constructed to be easily removable and installable on the exterior of the receptacle 5. The panel 53 may include advertising indicia 68 printed thereon and can be made of a polymeric type material. In the illustrated structure, the panel 53 is releasably secured to the receptacle 5 via the use of any plurality of hangers or projections 51. The hangers 51 include a stub 69 secured to and extending outwardly from the substantially straight side wall section 47. An enlarged head 70 can be provided at the free end of each of the stubs 69. Alternatively, the stub may be generally cylindrical without the enlarged head 70. The panel 53 is provided with a plurality of through apertures 71 sized and shaped similar to the stub 69 and smaller than the head 70. The panel 53 can be removably installed on the receptacle 5 by inserting a respective head 70 and stub 69 through a respective aperture 71. Removal of the panel 53 can be accomplished by resiliently deforming the panel 53 and stretching it over the heads 70 associated with the plurality of hangers 51 used to hold the panel 53 in place. Use of the panel 53 enables the container 1 to be simply and economically customized and decorated for use at a specific location or to provide advertising for specific products and/or to display specific messages or other information. It is recognized and anticipated that other attachment mechanisms other than the hangers 51 may be used to removably attach the display panel 53 to at least a portion of the exterior surface of the base receptacle 5.

The container 1 may also be provided with means to anchor the container at a specific location to help prevent it from being moved, for example, by high winds or the like. Preferably, during the molding process of the container 1, one or more eyelets 73 can be molded into the receptacle 5 as best shown in FIGS. 1 and 3, each eyelet projecting from a lower portion of the receptacle 5 and each having an aperture 74 extending therethrough for receipt of an anchor rope or cable 75 or the like.

The container 1 including the cover 3 and the receptacle 5 can be made by a suitable molding process using a polymeric material which may be filled, if so desired, as, for example, with glass fibers to increase the strength and agility of the overall container. The material can be polypropylene, high density polyethylene or the like. A preferred molding process is a blow molding process, however, other molding processes may be used, for example, rotational molding. The techniques and molding conditions for such processes are well known in the industry. Any suitable color can be provided in the plastic to provide color throughout various portions of the container 1. A preferred blow molding process will now be described.

Figure 2:
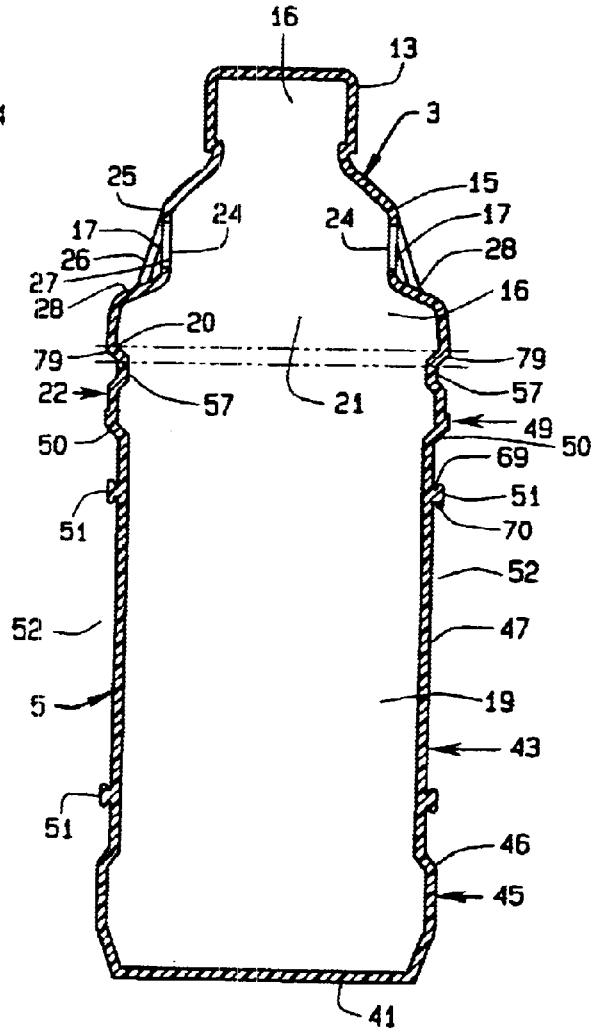
FIG. 2 is a cross-sectional view of the container of FIG. 1 as molded.

Blow molding is typically done by either forming a parison which is then clamped within a mold after which air is injected inside the parison to blow it outwardly and into contact with the surfaces of the mold cavity, the pressure being sufficient to conform the plastic to the shape of the mold cavity. The plastic is allowed to cool sufficiently so that it is rigid enough to remove from the mold for further processing. Another form of blow molding can be done by forming a precursor, for example, by injection molding and then moving the precursor into a mold cavity. The precursor is then urged into contact with the cavity of the mold with air pressure. The molded container preform is then allowed to cool sufficiently to remove it from the mold. The cavity is in the shape of the molded container preform as seen in FIG. 2. After molding, the plastic will shrink both from cooling and from the nature of the polymeric material as is well known in the industry. The mold is multi-piece and typically is a two piece mold.

In the present invention, the cover 3 and receptacle 5 are molded as a single piece or integral unit. As best illustrated in FIG. 2, the cover 3 and receptacle 5 are joined together by a web of material 79 which is integral with and connects the two component parts together. As described above, the upper end 22 of receptacle 5 has a perimeter smaller than the lower end 20 of cover 3. The inside perimeter of the lower cover end 20 is approximately the same size as the outer perimeter of the rim portion 62 to provide a snug or slight interference fit when the cover 3 is mounted on the receptacle 5. Because the cover 3 is molded simultaneously with the base receptacle 5, the shrinkage of the two components is substantially the same allowing for the close fit as just described without having to hand select mating cover and receptacle components for proper fit. After removal of the formed container preform, the cover 3 is separated from the base receptacle 5 by removal of the web 79. The web 79 may be removed by any suitable cutting device. After separation of the cover 3 from the receptacle 5, the link member 9 is secured to both the base receptacle 5 and cover 3 by attaching the ends of the link member 9 to the couplers 67. The couplers 67 are secured to the cover 3 and receptacle 5 prior to or after connection of the link member 9 thereto. The door 33 may then be installed. Holes are formed in the flange 30 to mate with holes in the securement ring 32 and with holes in the door 33. Screw fasteners 37 or any other suitable fastening means can then be used to secure the ring member 32 and door 33 to the cover 3. The anchor rope or cable 75 may then be secured to the eyelet 73 in any suitable manner. If desired, the panel 53 may also be installed.

Figure 7:
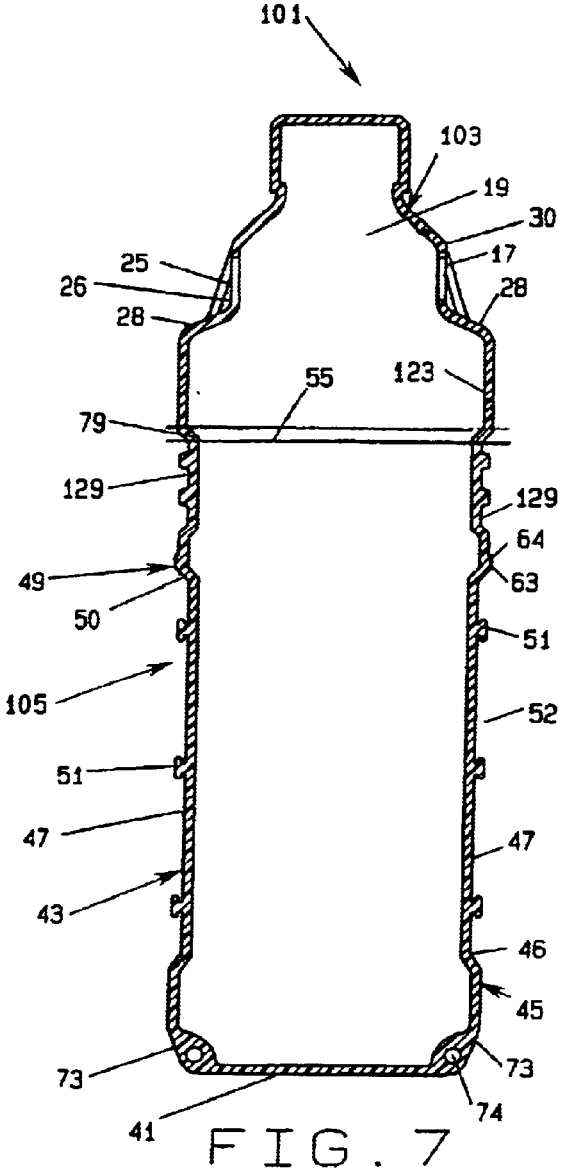
FIG. 7 is a cross-sectional view of another embodiment of the present container as molded.
Figure 8:
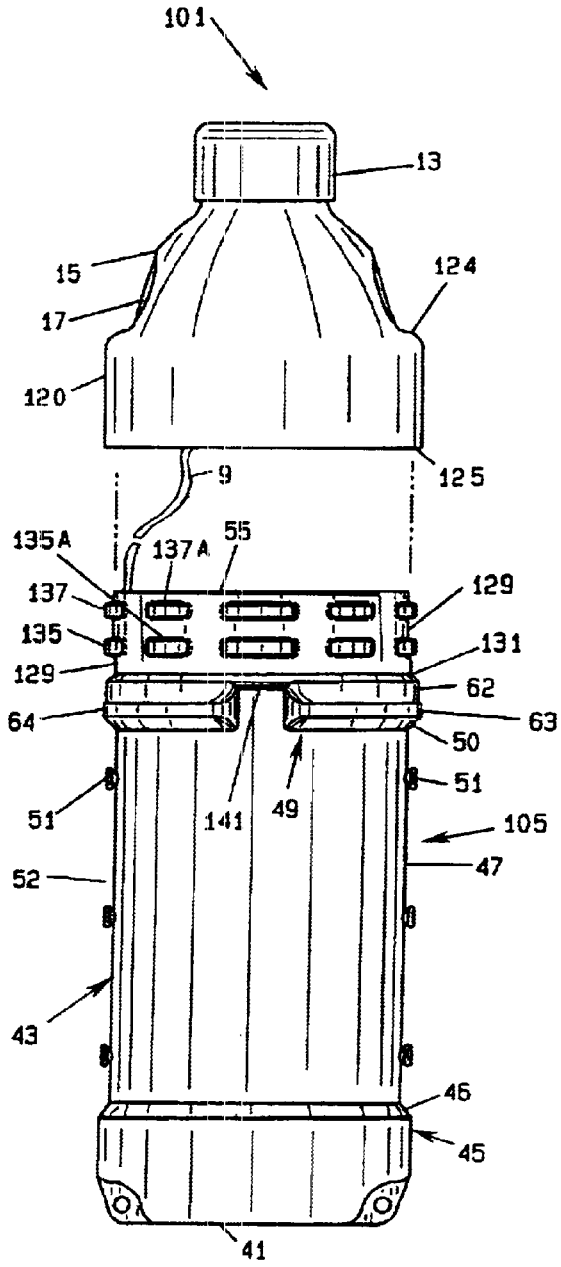
FIG. 8 is an exploded side elevational view of the container of FIG. 7.

FIGS. 7 and 8 show an alternative embodiment of the present invention. Much of the structure of the alternative embodiment is similar to or the same as the structure in FIGS. 1–6 wherein like or similar parts of the embodiment shown in FIGS. 7 and 8 are designated by the same numbers as used in the description of the first embodiment. Thus, a detailed description of the like or similar parts and construction of the alternative embodiment is not necessary. The embodiment shown in FIGS. 7 and 8 illustrates a container 101 comprising a cover 103 and a base receptacle 105. A liner 7 (not shown in FIGS. 7 and 8) can also be installed in the base receptacle 105 as described above. A weight 11, also not shown in FIGS. 7 and 8, can also be contained in the base receptacle 105. The cover 103 has a top portion 13, a side wall portion 15 and a port 17 generally as described. The cover 103 also has a lower end portion 120 which has a generally cylindrical inside surface 123 for a purpose later described. Actual movement of the cover 103 onto the base receptacle 105 is limited by the lower edge 125 of the cover 103 engaging the support ledge 64.

The collar 49 associated with the base receptacle 105 includes rim portions 62 and 63. The support ledge 64 extends between the rim portions 62 and 63. The base receptacle 105 includes an upper portion 129 and a tapered lead in portion 131 which extends between upper portion 129 and the rim portion 62. The upper receptacle portion 129 extends from the lead in portion 131 to the open mouth 55 and has a perimeter smaller than the perimeter of rim portion 63 to provide clearance between the inner cover surface 123 and the upper receptacle portion 129 when the cover 103 is installed on the base receptacle 105. The tapered lead in portion 131 facilitates mounting of the cover 103 onto the base receptacle 105 providing a transition from the upper receptacle portion 129 to the rim portion 62. One or more peripherally extending rims or projections 135 and 137 extend around a substantial portion of the perimeter of the upper receptacle portion 129. The rims or projections 135 and 137 are spaced apart in the direction of the longitudinal axis of the base receptacle 105 which is vertical when the base receptacle is in its normal upright position. The projections 135 and 137 project outwardly from the upper receptacle portion 129 and have a perimeter substantially equal to the perimeter of rim portion 62. This provides at least two vertically (or longitudinally) separated peripheral zones of contact with the inner cover surface 123 for removably mounting the cover 103 onto the base receptacle 105. A flexible bag liner 7 can be inserted into the interior of the base receptacle 105 having its upper end wrapped over the upper portion 129 and down over the rims or projections 135 and 137 and will be retained between and held in place by the engagement of the inner cover surface 123 with the rims or projections 135 and 137. As a result, in this particular embodiment, there is no need to pull the bag liner 7 all the way down over the rim portion 62 as explained above with respect to base receptacle 5. It is understood that additional peripheral zones of contact may also be provided. For example, the lower end portion 120 of cover 103 may also include a portion 124 which will engage at least a portion of the upper lip portion of base receptacle 105 when the cover 103 is installed on the base receptacle 105.

The rims or projections 135 and 137 extend substantially around the upper receptacle portion 129 and may include a continuous rim or, as illustrated, each rim 135 and 137 may include a plurality of spaced projections such as the peripherally extending projections designated 135A and 137A respectively in FIG. 8.

In the illustrated structure, the base receptacle 105 can be provided with integral handles 141. Preferably, there is one handle 141 on each side of the base receptacle 105. The handles 141 can be used to facilitate handling of the base receptacle for moving, emptying, and so forth. In an advantageous construction, the handles 141 are part of the collar 49.

In the illustrated form of the base receptacle 105, the container 101 has a generally cylindrical shape as does the inner cover surface 123. This allows for installation of the cover 103 without criticality of the relative orientation. When generally cylindrical, the perimeter and the periphery would be circumferential.

The container 101 can be made in a manner the same as or similar to the manufacture of the container 1 by molding as a one piece unit and then separating into a separate cover 103 and receptacle 105 by removal of the web 79 as illustrated in FIG. 7. As a result, the molding process discussed above with respect to the container 1 (FIGS. 1–6) is equally applicable to the molding and manufacture of container 101.

Thus, there has been shown and described several embodiments of a novel recycling container. As is evident from the foregoing description, certain aspects of the present invention are not limited by the particular details of the examples illustrated herein and it is therefore contemplated that other modifications and applications, or equivalents thereof, will occur to those skilled in the art. Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A container for the collection of waste products comprising:

a base receptacle including a bottom and an upstanding side wall defining an interior, said upstanding side wall forming an open mouth section at an end portion thereof opposite said bottom, said mouth section including an upper lip portion, at least one rim portion and a support ledge, the lip portion being associated with the upper end of said mouth section and being adapted to engage a portion of a flexible bag liner when positioned thereover, said lip portion being spaced inwardly of said at least one rim portion and said support ledge being spaced outwardly of said at least one rim portion, said at least one rim portion being positioned longitudinally between the lip portion and the support ledge and extending around at least a portion of the perimeter of said open mouth section;

a cover including a top portion extending over the open mouth section and a side wall portion depending from the top portion, said side wall having a lower end portion and a bottom edge, the lower end portion of said cover defining an open mouth section sized and shaped to be removably received over the open mouth section of said base receptacle with the bottom edge of said cover being engagable with said support ledge, the cover and base receptacle having at least two separate and longitudinally spaced zones of contact for engaging the flexible bag liner therebetween and having a gap between the zones of contact where the flexible bag liner is not engaged between the cover and base receptacle, at least a portion of said rim portion being engagable with at least a portion of the lower portion of said cover when said cover is installed on said base receptacle thereby providing a peripheral area of contact between said cover and at least a portion of the rim portion of said base receptacle for securing a flexible bag liner therebetween and forming one of said zones of contact, said cover having a through opening providing access to said interior for depositing waste product therein without removing the cover from the receptacle.

2. The container as set forth in claim 1 wherein a flexible bag liner is positioned in the base receptacle and has a portion positioned exteriorly of the lip portion and said at least one rim portion, said cover engaging said flexible bag liner at said at least one rim portion associated with said base receptacle.

3. The container as set forth in claim 1 wherein said cover includes an internal perimeter portion engagable with at least a portion of the lip portion of said base receptacle when said cover is installed on said base receptacle thereby providing a peripheral area of contact between said cover and at least a portion of the lip portion of said base receptacle for securing a flexible bag liner therebetween and forming another of said zones of contact.

4. The container as set forth in claim 1 wherein said opening is through said side wall of the cover.

5. The container as set forth in claim 4 wherein said opening includes a sill associated with a bottom portion of said opening, said sill sloping downwardly and outwardly away from said opening to provide a run off area for liquids.

6. The container as set forth in claim 4 wherein said cover includes a multi-flap type door mounted over said opening to control access to the interior of said base receptacle.

7. The container as set forth in claim 1 including a flexible link member having opposite end portions, one end portion of said flexible link member being secured to said cover and the opposite end portion of said flexible link member being secured to said base receptacle, said link member being contained within the interior of both said cover and said base receptacle when said cover is installed on the base receptacle.

8. The container as set forth in claim 7 wherein a portion of said flexible link member is positionable between a flexible bag liner and at least the lip portion of said base receptacle when the flexible bag liner is positioned within said base receptacle such that said flexible link member can be used to separate at least a portion of the liner from the base receptacle.

9. The container as set forth in claim 8 wherein said flexible link member is positionable between a flexible bag liner and both the lip portion and rim portion of said base receptacle when the flexible bag liner is positioned within said base receptacle.

10. The container as set forth in claim 1 wherein said base receptacle includes at least one eyelet adaptable for receiving an anchor rope therethrough.

11. The container as set forth in claim 1 wherein said base receptacle includes at least one attachment mechanism adaptable for removably attaching a display panel adjacent the exterior surface of at least a portion of said base receptacle.

12. The container as set forth in claim 11 wherein the base receptacle upstanding side wall has a plurality of attachment members extending outwardly from the substantially smooth outer surface of said receptacle side wall, said attachment members being positioned in spaced apart relationship relative to each other, and including a display panel having a plurality of openings associated therewith positioned in spaced apart relationship so as to register with at least some of said plurality of attachment members associated with said base receptacle for removably mounting said display panel to said base receptacle.

13. The container as set forth in claim 1 wherein said base receptacle includes a weight positioned adjacent the lower portion thereof.

14. The container as set forth in claim 1 wherein the base receptacle includes at least two rim portions separated along a longitudinal axis of the base receptacle.

15. The container as set forth in claim 14 wherein said at least two rim portions have substantially equal perimeters and the lower end portion of said cover is sized and shaped to engage said at least two rim portions thereby providing at least two peripheral areas of contact between said cover and said base receptacle for securing a flexible bag liner therebetween.

16. The container as set forth in claim 15 wherein the lower end portion of the cover is generally cylindrical.

17. A container for the collection of waste products comprising:

a base receptacle including a bottom wall and an upstanding side wall forming an opening at an upper portion of said base receptacle for receiving waste products therein, the upper portion of said upstanding side wall having a lip portion and at least two longitudinally spaced rim portions projecting outwardly from said upstanding side wall with a gap between two of said rim portions, each rim portion having a respective perimeter, and a support ledge projecting outwardly below said at least two rim portions; and a cover removably engagable with the at least two rim portions of said base receptacle, said cover including a side wall having a lower end portion and a bottom edge, said bottom edge being engagable with the support ledge of said base receptacle when said cover is mounted on said base receptacle, said at least two rim portions providing at least two longitudinally spaced peripheral areas of contact between said base receptacle and said cover for securing a flexible bag liner therebetween and said flexible bag liner is not engaged between the base receptacle and cover in the gap between two of the rim portions when the bottom edge of said cover is engaged with said supporting ledge, said cover having an opening associated therewith for inserting waste product therethrough.

18. The container as set forth in claim 17 wherein said at least two longitudinally spaced rim portions extend substantially continuously around the upstanding side wall of said base receptacle.

19. The container as set forth in claim 17 wherein each of said at least two longitudinally spaced rim portions comprises a plurality of peripherally spaced projections extending around the upstanding side wall of said base receptacle.

20. The container as set forth in claim 17 wherein said base receptacle includes at least a third rim portion, said supporting ledge projecting outwardly from said third rim portion.

21. The container as set forth in claim 20 wherein said third rim portion has a perimeter substantially equal to the perimeter of said at least two longitudinally spaced rim portions.

* * * * *